United States Patent [19]

Argibay, Jr. et al.

[11] 4,398,716

[45] Aug. 16, 1983

[54] HANDLER FOR TENNIS AND SIMILAR PLAY BALLS

[76] Inventors: John Argibay, Jr., 944 Springhaven Rd., Springfield, Pa. 19064; Jan A. Krejcar, 525 Maplewood Ave., Springfield, Pa. 19064

[21] Appl. No.: 303,086

[22] Filed: Sep. 17, 1981

[51] Int. Cl.[3] ..... A63B 61/00

[52] U.S. Cl. ..... 273/29 A; 273/201; 221/310; 294/19 A

[58] Field of Search ..... 273/29 R, 32 B, 32 D, 273/32 F, 33 A, 201, 29 A; 224/919, 311.2, 311.3; 221/45, 281, 283, 310; 294/19 A

[56] References Cited

U.S. PATENT DOCUMENTS

| | | | |
|---|---|---|---|
| 2,551,486 | 5/1951 | Burden | 294/19 A |
| 2,760,807 | 8/1956 | Watson | 294/19 A |
| 3,777,933 | 12/1973 | Joliot | 224/919 |
| 3,901,545 | 8/1975 | Shott | 294/19 A |
| 4,046,284 | 9/1977 | Samuelsson | 273/29 R |
| 4,253,668 | 3/1981 | Ose et al. | 294/19 A |
| 4,269,338 | 5/1981 | Sichel | 224/919 |

FOREIGN PATENT DOCUMENTS

| | | | |
|---|---|---|---|
| 613776 | 5/1979 | Fed. Rep. of Germany | 273/29 R |

*Primary Examiner*—Richard C. Pinkham
*Assistant Examiner*—T. Brown
*Attorney, Agent, or Firm*—John Lezdey

[57] ABSTRACT

Apparatus for carrying, retrieving and delivering play balls comprising at least one container for receiving one or more balls, each container being open at each end, and having a multiplicity of elastic deformable protrusions at its uppermost portion which are sufficiently deformable to permit entry of the play balls in the container, and a base means adapted to support said at least one container in a upright manner, said base means having a tray means at the bottom portion of said container for supporting said balls and permitting removal of a ball from each container.

4 Claims, 6 Drawing Figures

HANDLER FOR TENNIS AND SIMILAR PLAY BALLS

The present invention relates to an apparatus for carrying, retrieving and delivering play balls used in tennis, baseball, golf and the like.

It is common in the game of tennis to utilize a plurality of balls during practice and in non-tournament matches. It is furthermore known and desirable for each tennis player to have more than one ball available when serving since the player has two serves and it is desirable not to interrupt the serving process to wait for ball retrieval. Accordingly, it is common for players to either hold a spare ball in their hand or place the ball in the pockets of their clothes. The present invention in some instances overcomes the need for either holding an extra ball or placing the ball in the players pocket and further aids in the retrieval of balls which have been played.

SUMMARY OF THE INVENTION

It is an important feature of the present invention to provide a means for supporting a number of play balls, especially, tennis balls, while a player is in action.

It is a further feature of the present invention to provide a means for retrieving balls which have been played and for providing a holder for supporting vertically stacked balls and to permit one or more of the balls to be released as desired.

It is a still further object of the present invention to provide a tennis ball holder which is free standing and delivers one or more vertically stacked tennis balls to be played to the player.

In general the invention includes a suitable container in which one or more balls can be placed. The container is provided at one end with a resilient member which holds the ball and prevents its release from the container while being elastically deformable to permit manual ingress and egress from the container.

The present invention further provides a means for supporting the container in the vertical position so as to permit the delivery of one or more stacked balls.

This invention possesses many other advantages and has other objects which may be made more clearly apparent from the consideration of a form in which it may be embodied, and which is shown in the drawings accompanying and forming part of the present specification. This form will now be described in detail for the purposes of illustrating the general principles of the invention; but is to be understood that such detailed description is not to be taken in a limiting sense.

BRIEF DESCRIPTION OF THE DRAWINGS

FIG. 2 is a top plan view of the apparatus of of FIG. 1;

Figure 1:
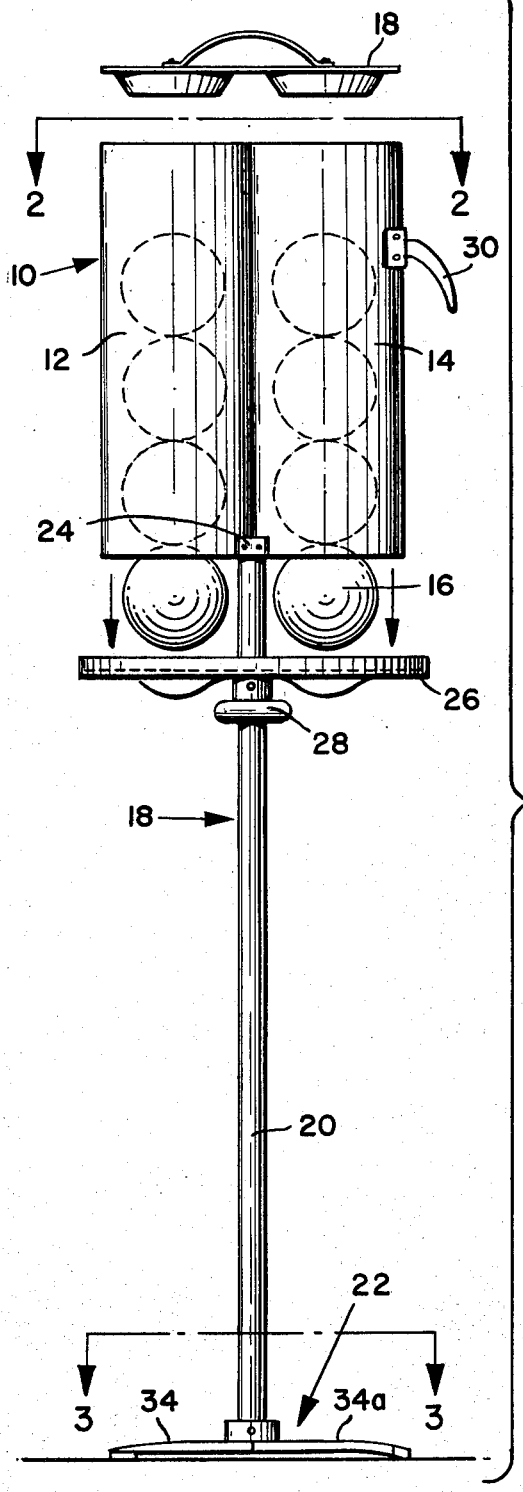
FIG. 1 is a respective of a tennis ball handling apparatus according to the present invention showing vertically stacked tennis balls contained therein.

As disclosed in FIG. 1 of the drawings, an elongated cannister or container 10 is provided having two compartments 12 and 14 suitable for vertically stacking a plurality of play balls 16. The container 10 is provided with a suitable top or lid 18 removably mounted on the upper end portion of the container. The lower portion of the container is open so as to permit the play balls to be taken one at a time from a ball keeper or tray 26.

The container 10 is mounted on a stand or support 18. The stand 18 preferably comprises a rod 20 which is fixed in a base 22 which is capable of supporting the stand 18 in a vertical position. The container 10 is fixed to the rod 20 with a bracket 24 that is fixedly mounted on the rod 20. Below the container 10 is a tray 26 which supports the play balls as they descend from the container 10. A stop 28 is provided so as to adjust the distance of the tray 26 from the container so as to take into consideration the size of the ball utilized. The stop 28 may comprise any one of combination of means capable of moving along the rod 20 and supporting the tray 26, such as an elastomer sleeve, as shown, or a nut and thread.

If desired, a handle 30 may be provided for carrying the apparatus or for conveniently attaching it to a further support, such as a fence.

Figure 2:
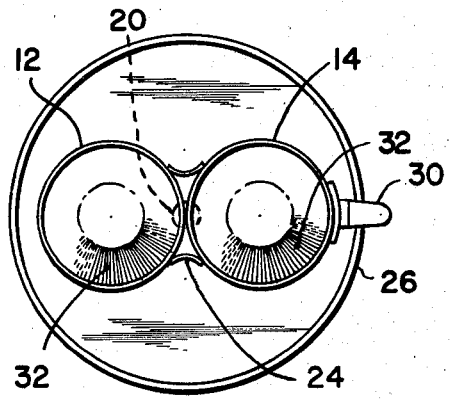
FIG. 2 is a top plan view of the apparatus of the present invention taken on line 2—2 of FIG. 1.

Within the container 10 at its uppermost portion is secured a multiplicity of elastic deformable protrusions or fingers 32 as illustrated in FIG. 2. The protrusions 32 are sufficiently deformable so as to permit entry of the play balls into the container and preventing the balls from falling from the container when inverted.

Figure 3:
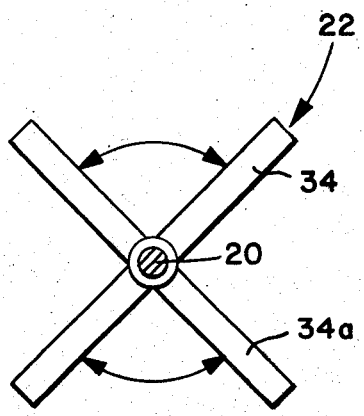
FIG. 3 is a section taken on line 3—3 of FIG. 1.

As shown in FIG. 3, the base 22 of the apparatus may comprise a pair of arms 34 and 34A which rotate to form a stable support.

In use of the apparatus, the balls 16 are placed in the container 10. The tray 26 is adjusted by means of the stop 28 to the proper level whereby the lowest ball supports the vertically stacked balls and can be removed so that the next ball takes it place on the tray 26, and preferably within a ball conforming detent. In order to recover the balls from the play area, the tray is caused to close the lower portion, and the apparatus with the lid off is inverted. By holding the base portion 22 it is merely necessary to recover the balls by placing the container over the ball. The elastic protrusions will hold the ball within the container and each successive ball pushes the first ball further into the container while beiing retained by means of the elastic protrusions 32. The apparatus can then be reinverted and have its tray adjusted to deliver the recovered balls into play.

Figure 4:
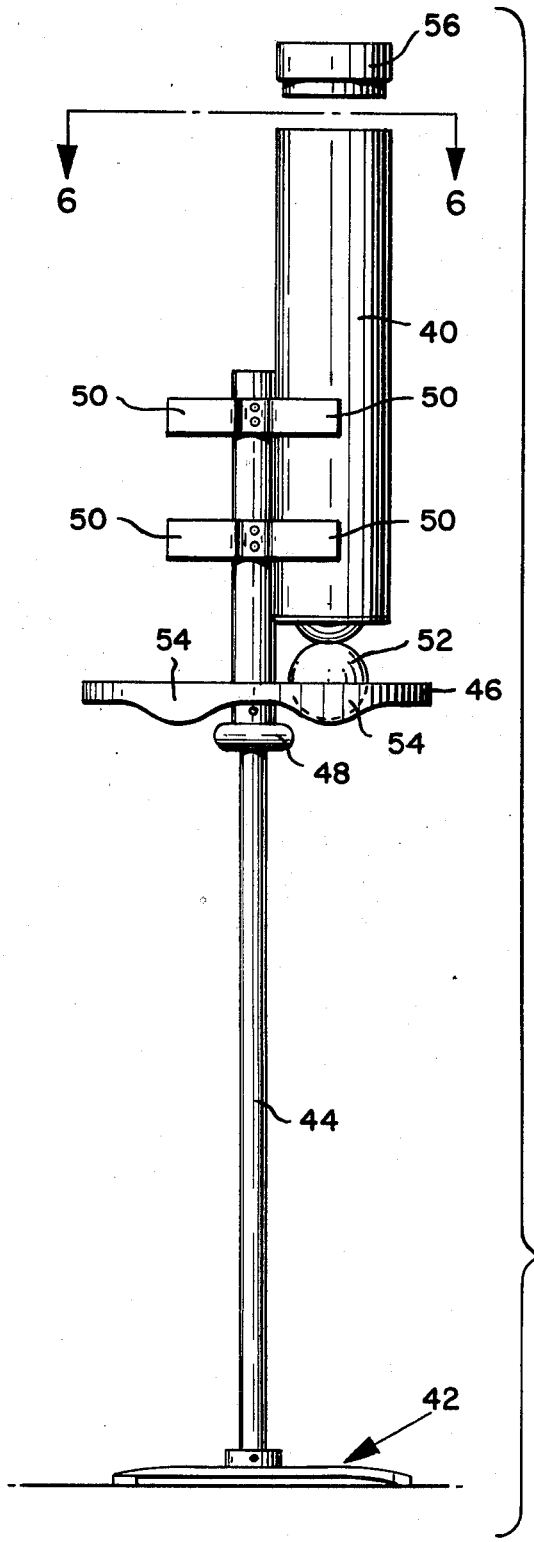
FIG. 4 is a respective view of a further apparatus according to the present invention.
Figure 5:
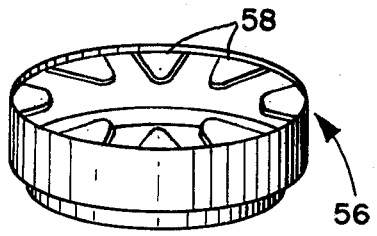
FIG. 5 is a perspective view of one form of lid of the present invention.
Figure 6:
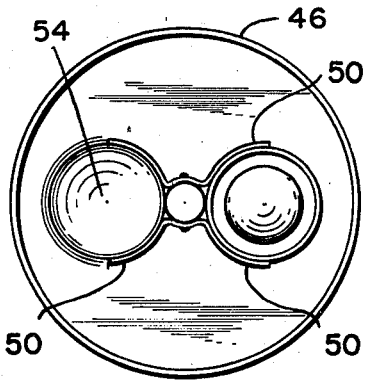
FIG. 6 is a top plan view taken on line 4—4 of FIG. 4.

As seen in FIG. 4, the ball handling apparatus of the present invention may be constructed so as to accomodate existing commercial ball cannisters or containers 40. The ball handling apparatus may contain a base 42 and a rod 44 which carries the slidable tray 46 that is adjusted into position by a stop means 48. At the uppermost portion of the rod 48 may be at least one pair of bracket or clip means 50 for retaining the container in position. The container is opened at its bottom portion in order to deliver the balls 52 onto the tray 46 which preferably contains a detent 54.

The top of the container is provided with a removable adapter 56 which contains on its internal wall a plurality of deformable elastic protrusions 58 which exert a pressure on the ball as it is placed into the container and retains the ball in the opening, if desired.

In use, at least one elongated cylinder or container that is opened at both ends is mounted in the bracket or clip means 50 for maintaining the cylinder in position. The apparatus is placed in the vertical position on its base 42 and the tray 54 is adjusted so as to be the desired distance from the container to permit removal of the first ball and the ascent of other vertically stacked balls. For retrieval of the balls, the tray 46 closes the lower portion of the cylinder and the adapter 56 is placed on the other open portion of the cylinder. Then, by merely placing the container over the ball, the ball or balls are retrieved and placed into the container.

These and other aspects of the invention would be evident to those skilled in the art having reference to the foregoing description applied to the presently preferred embodiments thereof.

We claim:

1. An apparatus for carrying, retrieving and dispensing play balls comprising at least one elongated container for receiving and dispensing one or more play balls, said at least one container being open at each end, one of said ends being a ball receiving end and the other end being a ball discharge end, said ball receiving end having a plurality of elastic protrusions which are sufficiently deformable to permit entry and retention of play balls in said at least one container, a ball being retained when said container is inverted, said ball receiving end is placed over a ball and said container is lowered to cause a ball to be forced past said protrusions for retrieving balls from the playing surface, an elongated vertically extending support member having said at least one container attached to its upper end and a base member attached to its lower end, a tray supported on said support member intermediated said upper and lower ends and closely adjacent said discharge end for receiving balls from said container, said balls being gravitationally discharged through said discharge end when said apparatus is returned to an upright position and supported on said base member.

2. The apparatus according to claim 1 wherein said multiplicity of elastic deformable protrusions forms part of a removable lid.

3. The apparatus according to claim 1 wherein said support means is a rod upon which said tray means is slidably mounted and a stop means is mounted on said rod below said tray so as to adjust the distance of said tray means from said discharge end of said at least one container.

4. The apparatus according to claim 3 wherein said stop means comprises an elastic sleeve.

* * * * *